United States Patent [19]

Leone et al.

[11] Patent Number: 4,587,764

[45] Date of Patent: May 13, 1986

[54] MACHINE FOR GRINDING THE EDGES OF A SHEET OF GLASS

[75] Inventors: Massimo Leone, Vasto; Francesco Torre, Pescara, both of Italy

[73] Assignee: Societa Italiana Vetro SIV S.p.A., Vasto, Italy

[21] Appl. No.: 603,651

[22] Filed: Apr. 24, 1984

[30] Foreign Application Priority Data

May 11, 1983 [IT] Italy ..... 48269 A/83

[51] Int. Cl.[4] ..... B24B 9/10

[52] U.S. Cl. ..... 51/33 W; 51/283 E

[58] Field of Search ..... 51/33 W, 283 E, 283 R, 51/47, 99, 165.71

[56] References Cited

U.S. PATENT DOCUMENTS 2,579,337 12/1951 Reaser et al. ..... 51/283 E
3,827,189 8/1974 Highberg et al. ..... 51/283

FOREIGN PATENT DOCUMENTS 2476059 8/1981 France ..... 51/283 R
0010466 1/1983 Japan ..... 51/283 R
0753608 8/1980 U.S.S.R. ..... 51/283 R

*Primary Examiner*—Frederick R. Schmidt
*Assistant Examiner*—Robert A. Rose
*Attorney, Agent, or Firm*—Browdy and Neimark

[57] ABSTRACT

A machine for grinding the edges of a sheet of glass, particularly windows for automobile, comprises, on a base, a motor for rotating the sheet of glass horizontally, a carrier moved horizontally by a bidirectional motor, which bears a wheel arm supporting in turn the grind wheel and a motor for it, the wheel arm being pushed toward the sheet of glass by a torgue motor supported on said carrier, the working parameters of the motors being controlled instantaneously by an electronic processor in which the profile of the sheet of glass is memorized.

2 Claims, 4 Drawing Figures

MACHINE FOR GRINDING THE EDGES OF A SHEET OF GLASS

BACKGROUND OF THE INVENTION

The present invention relates to a machine for grinding the edges of sheets of plate glass, such as those used particularly for automobile windows.

It is known that a sheet of glass previously cut according to a desired profile requires grinding of its edges with the double aim of smoothing the cutting edge which would otherwise create considerable problems during handling and removing of any peripheral microcracks which would cause breakage of the glass itself during the course of subsequent thermal treatment (tempering, bending, etc.).

The term grinding is used to define the operation which allows removing, by means of a diamond wheel, a thickness of material localized on the edge of the sheet, for a depth which varies as a function of the use for which the sheet is intended.

DESCRIPTION OF THE PRIOR ART

There are apparatuses for grinding sheets of glass already known.

For example, a type of machine used industrially is known in which the glass rotates around an axis of rotation around which also rotates a cam shaped like the glass. A follower wheel engages on the profile of the cam, to regulate the position of the grind wheel with respect to the glass. This grinding system is commonly known as cam grinding. Examples of these machines are illustrated in U.S. Pat. Nos. 2,561,929 and 2,293,828, as well as published Italian application No. 19366 A/79.

In all the machines illustrated in the patents, it should be noted that the distance between the pivot point of the wheel arm and the axis of the shaft fixed to the glass is fixed.

In French patent No. 2070521, which illustrates a manually controlled machine for processing profiles of sheets of glass at the artisan level, the distance between the axis of rotation of the wheel arm and the axis of the shaft of the glass is variable, although the support of the wheel arm moves in a complex fashion, in any case not rectilinear with respect to the chassis.

SUMMARY OF THE INVENTION

Working methods based on cam grinding or coupling present a series of inconveniences, such as: the necessity of having one or more cams for each pattern, leading to considerable equipment and storage costs; a long period necessary for passing from the grinding of one model to that of another; time wasted performing necessary adjustments, particularly after the grinding wheel has become worn; defects in processing due to the extreme precision required in positioning the glass with respect to the cam and the system of holding the grind wheel to the glass, which leads to defects at the point where grinding is initiated.

The aim of the present invention is to provide a machine perfect for processing edges, which allows achievement of greater precision and processing speeds, as well as greater reliability.

This aim is achieved with a machine realized so as to take advantage of the combination of three mechanical movements: a rotary movement of the piece to be processed, a rotary movement of the wheel arm about its pivot point, and an alternate linear movement of the pivot point itself in the horizontal direction.

The machine so realized requires no copying cam for performing the grinding operation, but allows the use of an electronic control system which allows fine adjustment of the pressure of the grind wheel on a point by point basis on the sheet of glass.

The system according to the present invention furthermore allows easy regulation of another parameter important for achieving defect-free processing of the edge, that is the peripheral speed of grinding which, theoretically, should remain constant along the entire edge of the piece.

In current machines this regulation of the speed is effected by subdividing the perimeter of the piece into a certain number of relatively small sectors, and fixing for each sector a certain value for the speed. Obviously, in this case the speed is constant over the distance corresponding to a certain sector, while the variations in curvature of the piece are not considered even though generally no sector has a constant radius edge. This approximation results in a variable effective peripheral speed, as soon as the radius of the perimeter changes. Italian application No. 19366 A/79 cited above has an electronic device which allows the variations in peripheral speed to be linearized, using as comparison the power absorbed by the grind wheel motor. However, there is an important motive for uncertainty in this patent: the power absorbed, in comparison, by the grind wheel motor is affected to a non-negligible degree by the wear of the grind wheel itself, and so it is not correct to use said power as a reference value. The machine according to the present invention on the other hand uses as a comparison parameter the shape of the piece memorized in the electronic processor, and said shape is subject to no variations.

The electronic device can guarantee a constant effective peripheral speed by varying the angular velocity of the grind wheel as a function of the geometry of the piece, in a practically continuous fashion. The electronic device can also control analogously the value of the pressure of the grind wheel on the glass by means of a torque motor which controls the wheel arm, as well as the values of the displacement of the wheel carriage.

Therefore, according to the present invention, the machine for grinding the edges of a sheet of glass comprises a chassis, a mandrel for supporting a sheet of glass to be processed, controlled by a motor to rotate the sheet around an axis perpendicular to its surface, and a mandrel for a grind wheel controlled by a motor for operating the grind wheel. It is characterized by the fact that a carriage is horizontally slidingly engaged with the chassis; a bidirectional motor supported on the chassis controls the horizontal displacement of said carriage, by means of a screw coupling; a wheel arm is pivotally supported on the carriage; a torque motor is supported by the carriage and controls the angular position of the wheel arm with respect to the carriage for controlling the operating pressure of the grind wheel; and an electronic processor in which the shape of the sheet of glass is memorized to instantaneously develop pulses which control the motors as a function of the relative position of the grind wheel and the edge of the sheet of glass, so as to determine the operating parameters of said motors for each small section of the edge of the sheet.

DESCRIPTION OF THE DRAWINGS

The invention will be better illustrated below in an exemplifying embodiment, with reference to the attached drawings in which.

DETAILED DESCRIPTION OF THE INVENTION

Figure 1:
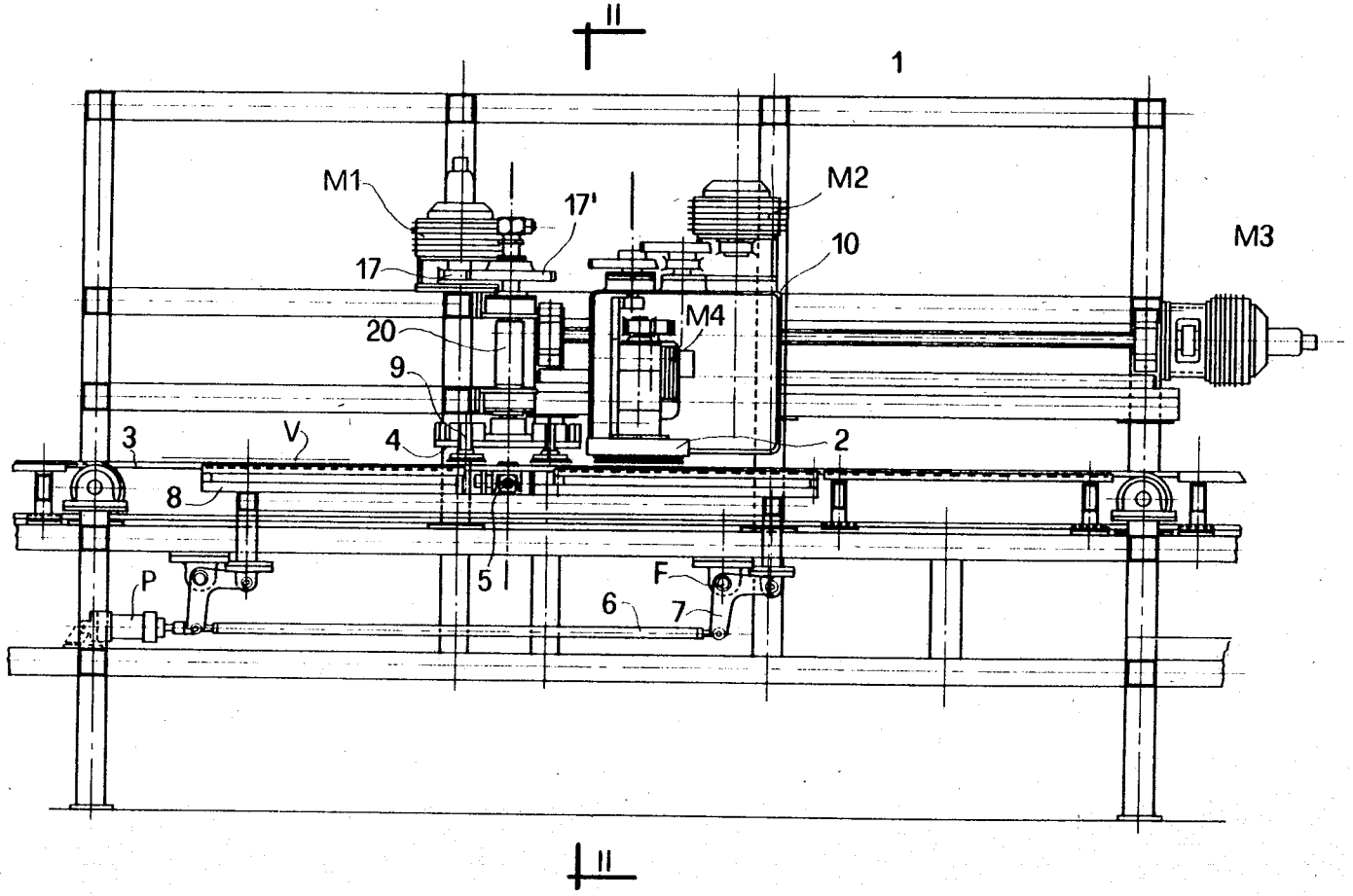
FIG. 1 shows a side view of the machine.
Figure 2:
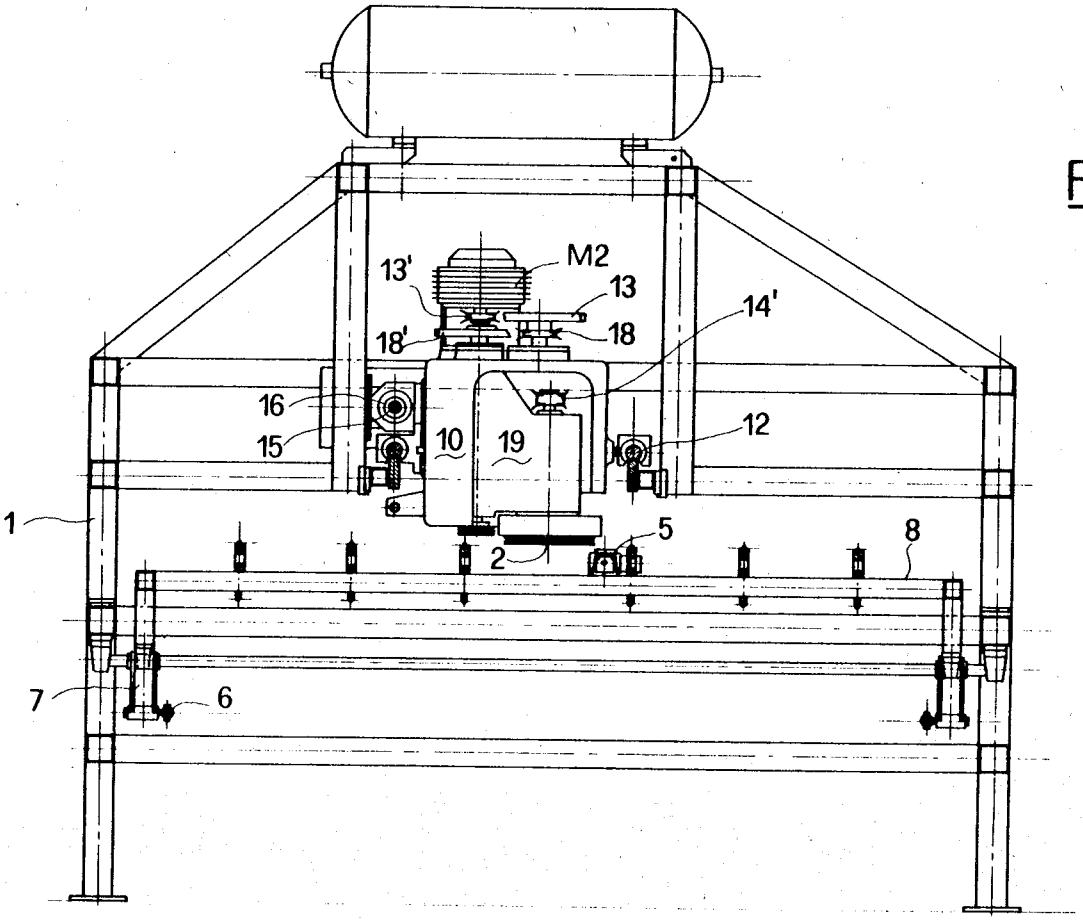
FIG. 2 shows a section along line II—II in FIG. 1.
Figure 3:
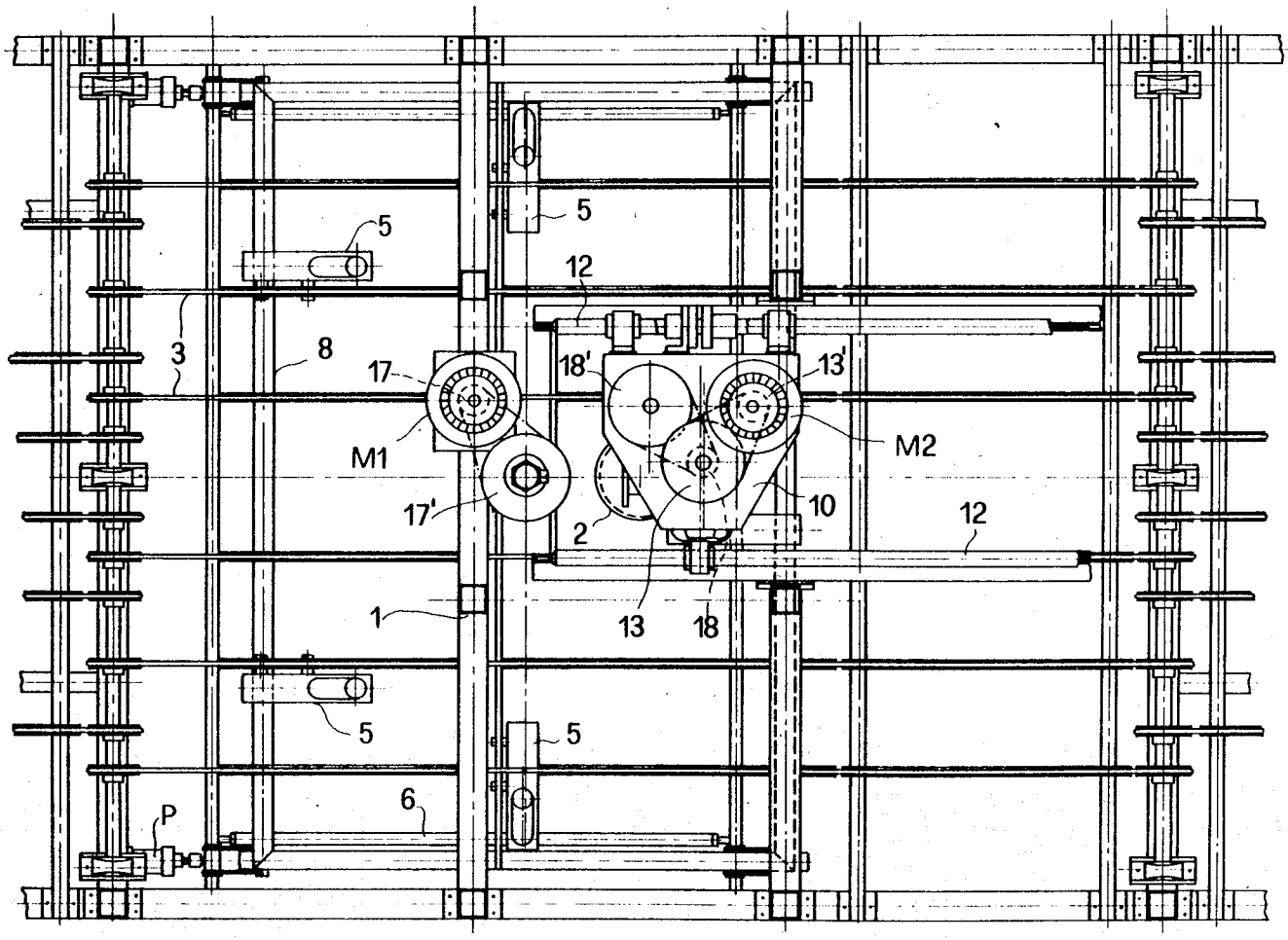
FIG. 3 shows a top view of the machine.

With reference to FIGS. 1 to 3, the machine is placed on a chassis 1 consisting of a beam frame. The sheet of glass V, already cut into its final desired shape, is transported under the grinding machine by conveyor belts 3. In correspondence with the plate suction cup 4, the sheet of glass V stops and is centered by pneumatic abutments 5. The arrangement of the abutments is more clearly visible in FIG. 3. They are raised when the sheet arrives beneath plate 4, and center it.

The glass is then raised by means of a movable surface 8, the movement linkage of which is indicated in FIG. 1 with numbers 6 and 7. In practice, the piston P pushes rod 6 toward the outside, and the levers 7 rotate around pivot F to raise surface 8 to a constant height.

Raising surface 8 brings the sheet of glass V into contact with the suction cups 9. A vacuum is created in the latter to support the glass and keep it from moving with respect to its mandrel 20 during the subsequent grinding phase, due to the force exerted by grind wheel 2.

When the sheet of glass V has been solidly engaged by the suctions cups due to the vacuum induced in them, the rod 6 is pushed into piston P and the movable surface 8 is lowered. Contemporaneously, the wheel arm 19 (see FIG. 4) rotates on its pins 21,21' due to the movement generated by a torque motor M2, and the grind wheel 2 approaches the glass until it comes into contact with it at one point.

Grind wheel 2 begins to rotate due to a motor M4 which is carried by wheel arm 19, and transmits the motion to the mandrel 22 of the grind wheel 2 by means of a transmission of sheaves and timing belts 14,14'.

The glass rotates around its own mandrel 20, and this rotation movement is supplied by a motor M1 fixed to the chassis 1, by means of a sheaves and timing belts transmission 17,17'. The glass rotates in the opposite direction from the grind wheel 2.

Figure 4:
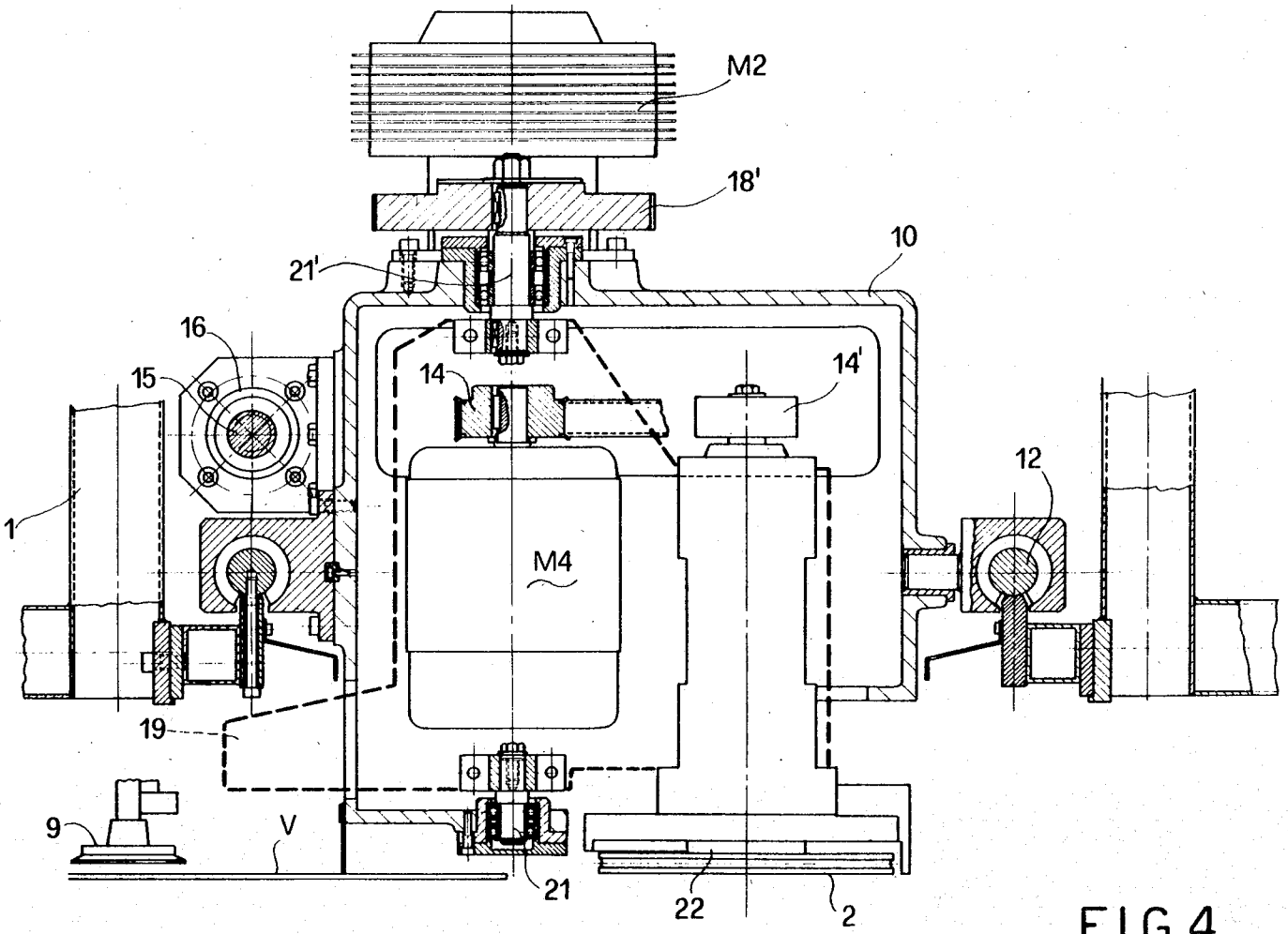
FIG. 4 is a particular view in the same direction as FIG. 2 and partially sectioned, showing the wheel arm carriage as well as the wheel arm itself with the grind wheel and its motor.

The wheel arm 19 is supported slidingly, by means of pins 21,21', on a carriage 10 which moves in a horizontal direction, supported and guided by rod guides 12 fixed to chassis 1; its displacement is controlled by a bidirectional motor M3 by means of a worm system 15 with ball circulation screw 16 (FIG. 4).

As shown in FIG. 4, the torque motor M2 is supported on carriage 10. By means of a sheaves and timing belt transmission 13,13' and 18,18', motor M2 controls the pressure of the grind wheel 2 on the glass, increasing or decreasing the torque acting on the spring wheel arm 19, and guarantees that the grind wheel 2 is in constant contact with the glass V.

Now that the structure of the machine has been described, its operation may be as well.

As will be explained, the grinding is effected by means of rotating the glass around a vertical axis and having the diamond wheel follow the structure of the glass, without the aid of a cam.

The machine is controlled by three direct current motors M1, M2, M3 which control the grinding parameters on a point by point basis. The grinding pressure, one of the most important parameters, is controlled by means of motor M2, and the peripheral speed of the grinding, the second critical parameter, is controlled with motor M1, so that accurate processing is achieved without the aid of a copying cam.

These motors are controlled by means of an electronic processor in which the profile of the glass is memorized, as mentioned above. For this memorization, the shape of the glass is defined geometrically according to straight sections and arcs of a circle. The number of these sections varies as a function of the shape's geometry. Each section is identified by the cartesian coordinates of its ends, referring to the center of rotation of the glass which thus serves as the origin of the axes.

The curved sections are characterized in addition by the value of the radius. All the sections are further divided into a certain number of parts as a function of the particular shape of the section itself.

The geometric data above, plus the technological processing data (optimal grinding speed, desired removal depth, mechanical properties of the grind wheel), are then placed in a computer where, when analyzed with appropriate development software, they supply the parameters to be placed in the electronic process which controls the grinding machine.

The shape of the glass is thus ideally subdivided into a certain, relatively large number of sectors, where said number may be over one hundred.

For each of these sectors the processor supplies the angular amplitude, the rotation speed of the glass, the unit displacement of the carriage, the pressure of the grind wheel.

The group of these parameters makes up the working program which may be transmitted to the grinding machine rapidly by means of the computer itself, a magnetic tape recorder, or by hand. The program imposed is read and interpreted by a digital counting circuit, and is presented to the operations with an analog pilot signal by means of digital-to-analog convertors. Therefore the programmable electronic device controls the three critical motors in direct current, that is, motor M1 which controls the speed of rotation of the glass being processed, motor M2 which controls the contact pressure between the grind wheel and the glass, guaranteeing continuous contact and a suitable removing depth, as well as bidirectional motor M3 which controls the position of the wheel carriage with respect to the rotating glass.

Therefore, it is clear how the machine according to the present invention achieves the aims and advantages cited above.

Even though one exemplifying embodiment has been described in considerable detail, variations and modifications may be carried out without going beyond the bounds of the present invention.

We claim:

1. In a machine for grinding the edges of a sheet of glass including a chassis, a horizontally sliding carriage engaged with said chassis by means of a screw coupling and a rotatable shaft for supporting said sheet of glass, the improvement comprising in combination:

a first motor fixed to said chassis for rotating said shaft by 360° around a vertical axis perpendicular to said sheet; a wheel arm pivotally supported on said carriage having a vertical rotation axis; a torque motor supported on said carriage for controlling the angular position of said wheel arm with respect to said carriage; a vertical mandrel rotatably supported on said wheel arm, said mandrel having a powered grind wheel at one free end thereof, a bidirectional motor supported on said chassis for controlling the horizontal displacement of said carriage; and an electronic processor for memorizing a profile of the sheet of glass and for generating instantaneous pulses to control said first motor, said torque motor and said bidirectional motor, said instantaneous pulses being a function of the relative position of the grindwheel and the edge of the sheet of glass, whereby the operating parameters of said motors are established for each small section of the sheet edge.

2. Machine according to claim 1, in which said torque motor (M2) is connected to the wheel arm (19) by means of a sheaves and belts transmission.

* * * * *